US009039543B2

(12) United States Patent
Mizutani

(10) Patent No.: US 9,039,543 B2
(45) Date of Patent: May 26, 2015

(54) GOLF CLUB HEAD

(75) Inventor: Naruhiro Mizutani, Kobe (JP)

(73) Assignee: SRI SPORTS LIMITED, Kobe (JP)

( * ) Notice: Subject to any disclaimer, the term of this patent is extended or adjusted under 35 U.S.C. 154(b) by 605 days.

(21) Appl. No.: 13/327,987

(22) Filed: Dec. 16, 2011

(65) Prior Publication Data

US 2012/0172144 A1 Jul. 5, 2012

(30) Foreign Application Priority Data

Dec. 29, 2010 (JP) ..... 2010-294412

(51) Int. Cl.
*A63B 53/04* (2006.01)
*A63B 59/00* (2006.01)

(52) U.S. Cl.
CPC ..... *A63B 59/0092* (2013.01); *A63B 2209/02* (2013.01); *A63B 53/047* (2013.01); *A63B 2053/042* (2013.01); *A63B 2053/0458* (2013.01); *A63B 2053/0425* (2013.01); *A63B 2209/00* (2013.01); *A63B 53/0466* (2013.01); *A63B 53/0487* (2013.01)

(58) Field of Classification Search
USPC ..... 473/324–350
See application file for complete search history.

(56) References Cited

U.S. PATENT DOCUMENTS 3,881,733 A * 5/1975 Csernits ..... 473/330
4,928,972 A * 5/1990 Nakanishi et al. ..... 473/332
5,409,229 A * 4/1995 Schmidt et al. ..... 473/332
5,586,947 A * 12/1996 Hutin ..... 473/324
5,588,923 A * 12/1996 Schmidt et al. ..... 473/340
5,605,511 A * 2/1997 Schmidt et al. ..... 473/324
5,626,530 A * 5/1997 Schmidt et al. ..... 473/324
5,649,872 A * 7/1997 Antonious ..... 473/332
5,704,849 A * 1/1998 Schmidt et al. ..... 473/324
6,592,469 B2 * 7/2003 Gilbert ..... 473/350
6,875,124 B2 * 4/2005 Gilbert et al. ..... 473/290
6,921,344 B2 * 7/2005 Gilbert et al. ..... 473/334
7,387,579 B2 * 6/2008 Lin et al. ..... 473/332
7,803,068 B2 * 9/2010 Clausen et al. ..... 473/350
7,819,757 B2 * 10/2010 Soracco et al. ..... 473/332
7,833,110 B2 * 11/2010 Nakamura ..... 473/332
7,892,106 B2 * 2/2011 Matsunaga ..... 473/290
7,997,999 B2 * 8/2011 Roach et al. ..... 473/332
8,057,322 B2 * 11/2011 Wallans ..... 473/329
8,092,318 B2 * 1/2012 Oldknow et al. ..... 473/329
8,182,359 B2 * 5/2012 Gilbert et al. ..... 473/290
8,187,117 B2 * 5/2012 Blumenkrantz et al. ..... 473/329

(Continued)

FOREIGN PATENT DOCUMENTS

JP 11-262973 A 9/1999
JP 2003-284794 A 10/2003

(Continued)

*Primary Examiner* — Alvin Hunter
(74) *Attorney, Agent, or Firm* — Birch, Stewart, Kolasch & Birch, LLP

(57) ABSTRACT

A head 1 is provided with a head body h1 and an adherend s1. The adherend s1 has a cast resin 53 formed by casting, a metal part 51, and a vibration absorber 55. The cast resin 53 has a formed surface formed by the metal part 51. The cast resin 53 further may have a formed surface formed by the vibration absorber 55. A base material of the cast resin 53 is an epoxy resin, for example. The cast resin 53 may have a cutting surface PL1. The cutting surface PL1 may be a joint surface of the adherend to the head body h1. Preferably, a loss tangent tan δ of the vibration absorber 55 is 0.07 or greater and 0.25 or less.

10 Claims, 14 Drawing Sheets

(56) References Cited

U.S. PATENT DOCUMENTS

| | | | | |
|---|---|---|---|---|
| 8,267,807 | B2 * | 9/2012 | Takechi et al. | 473/332 |
| 8,328,660 | B2 * | 12/2012 | Roberts et al. | 473/329 |
| 8,333,667 | B2 * | 12/2012 | Kumamoto et al. | 473/342 |
| 8,632,421 | B2 * | 1/2014 | Park et al. | 473/332 |
| 2002/0098910 | A1 * | 7/2002 | Gilbert | 473/332 |
| 2006/0166758 | A1 | 7/2006 | Roberts et al. | |
| 2010/0056296 | A1 | 3/2010 | Kumamoto et al. | |

FOREIGN PATENT DOCUMENTS

| | | | |
|---|---|---|---|
| JP | 2008-125811 | A | 6/2008 |
| JP | 2009-112585 | A | 5/2009 |
| JP | 2010-148565 | A | 7/2010 |

* cited by examiner

GOLF CLUB HEAD

The present application claims priority on Patent Application No. 2010-294412 filed in JAPAN on Dec. 29, 2010, the entire contents of which are hereby incorporated by reference.

BACKGROUND OF THE INVENTION

1. Field of the Invention

The present invention relates to a golf club head.

2. Description of the Related Art

A golf club head to which an adherend such as a badge is mounted has been known. For example, the adherend is mounted to a back surface of a face in an iron type head. The adherend is mounted to a sole or the like in a wood type head.

Japanese Patent Application Laid-Open No. 2008-125811 discloses a head in which a resin plate is mounted to a back surface of a hitting part. The resin plate is mounted by a double-faced tape having a thickness having 1.0 mm or greater and 3.0 mm or less. The point that a plurality of double-faced tapes is stacked is disclosed.

Japanese Patent Application Laid-Open No. 2010-115318 (US Patent Application No. 2010/0056296 A1) discloses a head having an adherend. The adherend is bonded to a head body by a double-stick tape. In the head, the head body or the adherend has a recess part. An inner surface of the recess part and a bonding surface are adjacent to each other.

Japanese Patent Application Laid-Open No. 2003-284794 discloses a badge plate stuck on a cavity bottom surface of an iron golf club head. The badge plate is coated with metal plating.

US Patent Application No. 2006/0166758 A1 discloses an iron head having a back surface having a recess part. An insert is provided in the recess part. The insertion constituted by a plurality of members is disclosed.

Japanese Patent No. 2792642 (U.S. Pat. No. 5,409,229) discloses a golf club having a back surface to which an attenuation means is mounted. The point that the attenuation means includes a thin plate, and a pressure-sensitive adhesive or an adhesive for sticking the thin plate is disclosed.

SUMMARY OF THE INVENTION

The head receives a great impact shock in impact. It is preferable that the adherend is hardly come off even if the impact shock is added. On the other hand, a function such as impact absorptivity may be added to the adherend. In this case, in respect of a degree of freedom in design and material selection, an adherend obtained by combining a plurality of materials is preferable. However, when a plurality of members is provided, joining strength between members poses a problem.

It is an object of the present invention to provide a golf club head having an adherend hardly come off and having excellent durability.

A golf club head of the present invention is provided with a head body and an adherend. The adherend has a cast resin formed by casting, a metal part, and a vibration absorber. The cast resin has a formed surface formed by the metal part.

Preferably, the cast resin further has a formed surface formed by the vibration absorber.

Preferably, a base material of the cast resin is an epoxy resin.

Preferably, in the head, the vibration absorber is exposed.

Preferably, the vibration absorber has a portion sandwiched between the cast resin and the metal part.

Preferably, the metal part has a first portion and a second portion. Preferably, the second portion is made of a surface forming layer. Preferably, a portion in which the first portion and the second portion are brought into contact exists. Preferably, a portion in which the cast resin and the second portion are brought into contact exists.

Preferably, the metal part has a first portion and a second portion. Preferably, the second portion is made of a surface forming layer. Preferably, a portion in which the first portion and the second portion are brought into contact exists. Preferably, the vibration absorber has a portion sandwiched between the first portion and the second portion.

Preferably, the cast resin has a cutting surface. Preferably, the cutting surface is a joint surface of the adherend to the head body.

Preferably, the cast resin has a thin-walled part having a thickness equal to or less than 2.5 mm between the cutting surface and the metal part.

Preferably, a loss tangent tan δ of the vibration absorber is 0.07 or greater and 0.25 or less.

An adherend having high joining strength between members and excellent durability can be obtained.

BRIEF DESCRIPTION OF THE DRAWINGS

FIG. 4 is also a cross sectional view of example 1;

FIG. 6 is a cross sectional view taken along line F2-F2 (line F6-F6) of FIG. 5;

DESCRIPTION OF THE PREFERRED EMBODIMENTS

Hereinafter, the present invention will be described in detail based on the preferred embodiments with appropriate references to the drawings.

Figure 1:
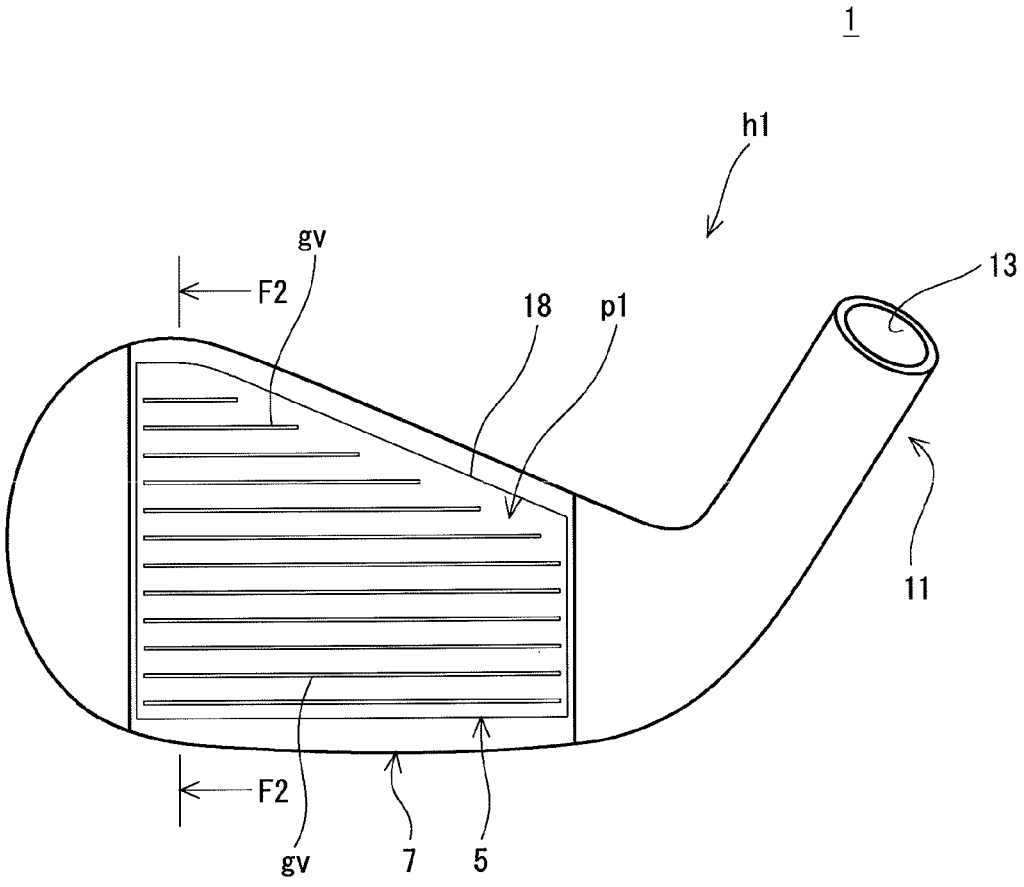
FIG. 1 is a view of a golf club head of a first embodiment of the present invention, as viewed from a face side.
Figure 2:
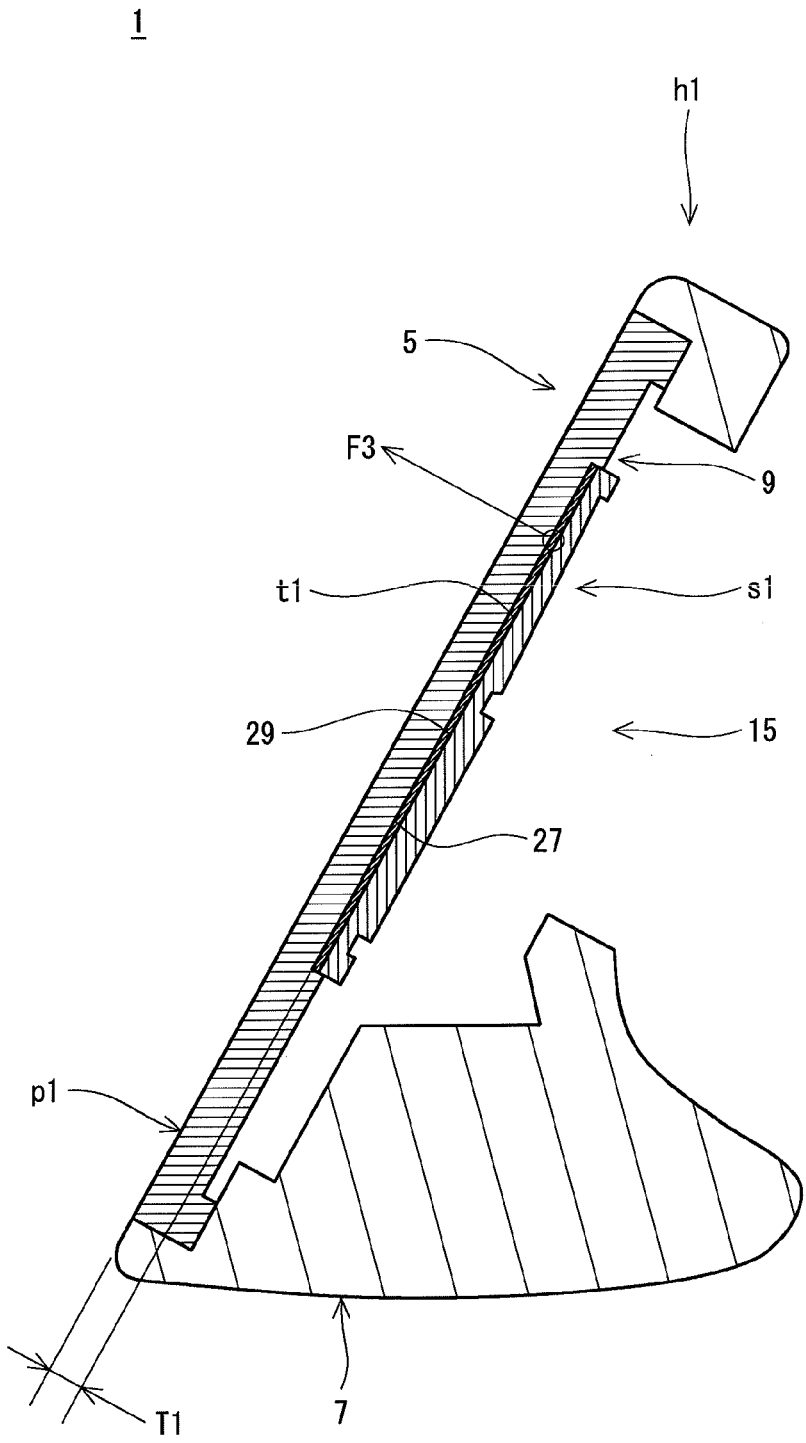
FIG. 2 is a cross sectional view taken along line F2-F2 of FIG. 1.

As shown in FIGS. 1 and 2, a head 1 is an iron type golf club head. The head 1 has a head body h1, an adherend s1, and a double-stick tape t1. The head body h1 has a face plate p1. The adherend s1 is a member having an approximately thin plate shape as a whole. The typical adherend s1 is a badge. Typically, logo marks or characters are shown on the adherend s1.

The double-stick tape t1 is located between the adherend s1 and the head body h1. More particularly, the double-stick tape t1 is located between the adherend s1 and the face plate p1. The adherend s1 is bonded to the head body h1 by the double-stick tape t1. A profile shape of the double-stick tape t1 is substantially equal to that of the adherend s1. The double-stick tape t1 is a sheet having both surfaces having cohesiveness.

In FIG. 2, the double-stick tape t1 is shown as a single layer. However, in fact, the double-stick tape t1 includes a plurality of layers as described later.

The head body h1 has a face surface 5, a sole surface 7, a back surface 9, and a hosel part 11. A plurality of grooves gv is formed in the face surface 5. The hosel part 11 has a shaft hole 13. A so-called cavity 15 is formed in the back surface 9. The head 1 is a so-called cavity back iron. The adherend s1 is located on a bottom surface of the cavity 15.

A front surface of the face plate p1 is the face surface 5. The adherend s1 is stuck on a back surface of the face plate p1. A thickness of the face at a portion on which the adherend s1 is stuck is shown by numeral T1 in FIG. 2. In respect of durability, the thickness T1 is preferably equal to or greater than 1.5 mm, more preferably equal to or greater than 1.8 mm, and still more preferably equal to or greater than 2.0 mm. When the thickness T1 is small, vibration of a face part in hitting is great. When the thickness T1 is small, a great impact force acts on the adherend s1. Therefore, in this case, an effect of the present invention can be advanced. In this respect, the thickness T1 is preferably equal to or less than 3.0 mm, more preferably equal to or less than 2.7 mm, and still more preferably equal to or less than 2.4 mm.

Figure 3:
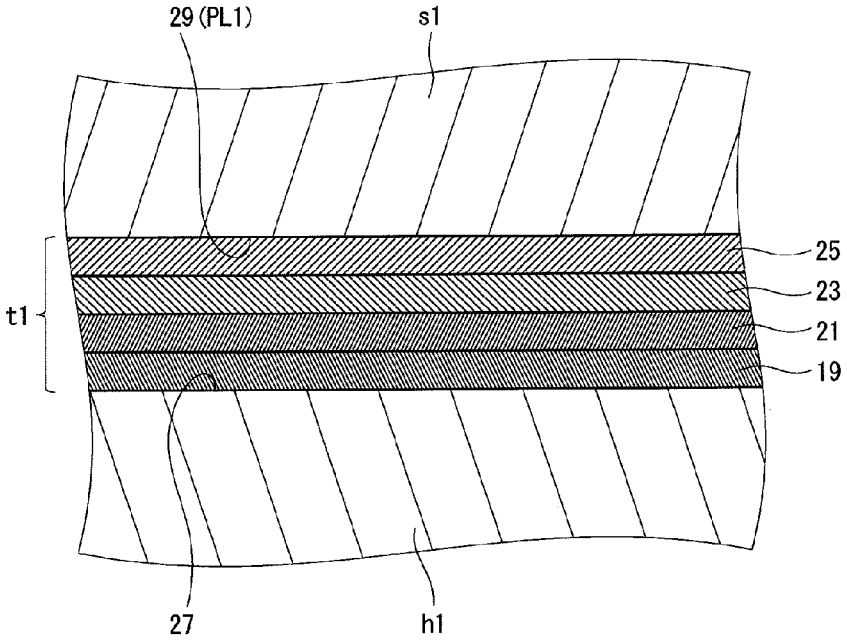
FIG. 3 is an enlarged view of an inside of a circle of FIG. 2.

FIG. 3 is an enlarged view of an inside of a circle shown by F3 in FIG. 2. A section of the double-stick tape t1 is shown in FIG. 3. The double-stick tape t1 is made of a plurality of layers. In the embodiment of FIG. 3, the double-stick tape t1 has a four layer structure. The four layers are a first layer 19, a second layer 21, a third layer 23, and a fourth layer 25 in this order from the head body h1 side. The first layer 19 is made of a pressure-sensitive adhesive. Preferable examples of the pressure-sensitive adhesive include an acrylic compound. The second layer 21 is a base material layer. Examples of a material of the base material layer include an acrylic resin. The third layer 23 is a nonwoven fabric layer. The fourth layer 25 is made of a pressure-sensitive adhesive. Although boundaries between the layers are shown in a flat surface shape in FIG. 3, unevenness may exist on each of the boundaries. Particularly, the boundary between the nonwoven fabric layer 23 and the other layer is usually uneven.

The first layer 19 (first pressure-sensitive adhesive layer) is brought into contact with a bonding surface 27 of the head body h1. The fourth layer 25 (second pressure-sensitive adhesive layer) is brought into contact with a bonding surface 29 of the adherend s1. The bonding surface 29 is a joint surface of the head body h1 and the adherend S1.

The double-stick tape t1 including the nonwoven fabric layer has excellent vibration absorptivity.

Examples of the pressure-sensitive adhesive include an epoxy pressure-sensitive adhesive and a urethane pressure-sensitive adhesive in addition to the acrylic pressure-sensitive adhesive.

Figure 4:
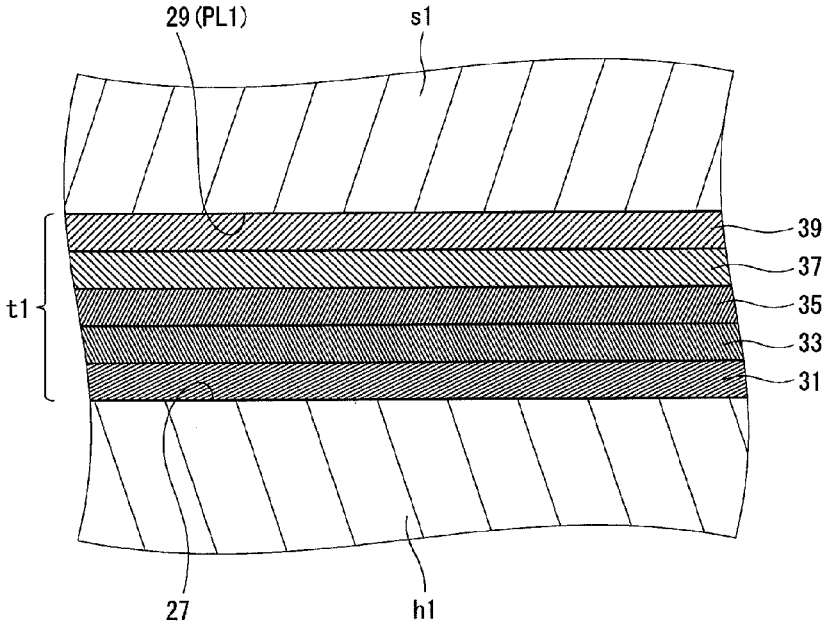
FIG. 4 is a modified embodiment of FIG. 3.

FIG. 4 is a cross sectional view showing another example of the double-stick tape t1. In the example, the double-stick tape t1 has a five layer structure.

The five layers are a first layer 31, a second layer 33, a third layer 35, a fourth layer 37, and a fifth layer 39 in this order from the head body h1 side. The first layer 31 and the fifth layer 39 are pressure-sensitive adhesive layers. The second layer 33 and the fourth layer 37 are base material layers. A material of the base material layer is a resin. As the resin, an acrylic resin is suitable. The third layer 35 is a nonwoven fabric layer. The double-stick tape t1 also has excellent vibration absorptivity.

Figure 5:
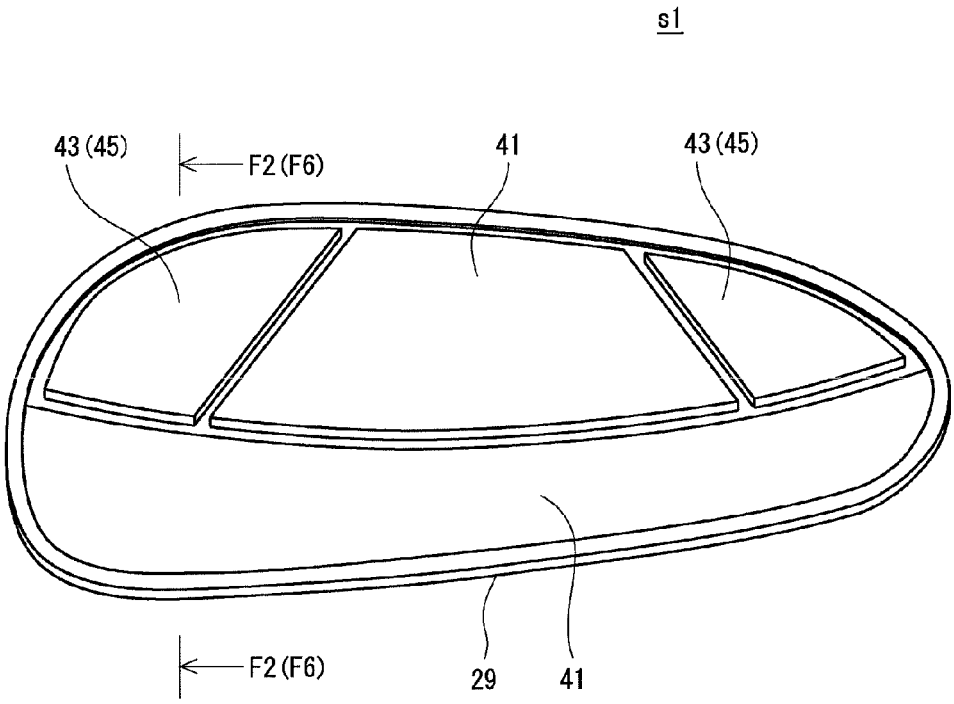
FIG. 5 is a perspective view of an adherend according to the first embodiment, and the first embodiment is also example 1.

FIG. 5 is a perspective view of the adherend s1. Line F2-F2 described in FIG. 1 is described also in FIG. 5. A surface opposite to the bonding surface 29 is shown in FIG. 5. That is, a surface (hereinafter, merely referred to as an exposed surface) exposed when the adherend s1 is stuck on the head body h1 is shown in FIG. 5.

The adherend s1 has an approximately plate shape as a whole. However, the exposed surface of the adherend s1 has unevenness. The adherend s1 has a protruding part 45. The protruding part 45 is made of a vibration absorber.

The exposed surface of the adherend s1 has a metal surface 41 and a nonmetal surface 43. The nonmetal surface 43 is made of the vibration absorber 55. The vibration absorber 55 is exposed in the completed head. The exposure can allow increase of a thickness of the vibration absorber 55 while suppressing a thickness of the adherend s1. The increased thickness can contribute to an increase in vibration absorptivity.

Figure 6:
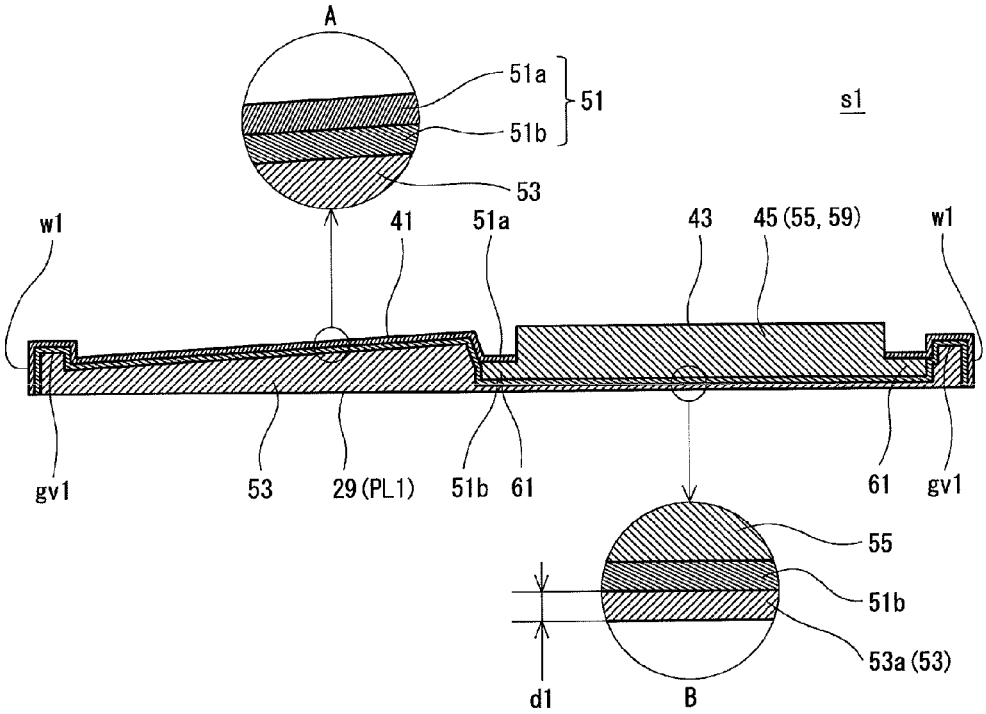
FIG. 6 is a cross sectional view of the adherend according to the first embodiment.

FIG. 6 is a cross sectional view taken along line F6-F6 of FIG. 5. The line F6-F6 coincides with the above-mentioned line F2-F2. Although the description is omitted in FIGS. 2, 3, and 4, the adherend s1 is made of a plurality of materials.

The adherend s1 has a metal part 51, a cast resin 53, and the vibration absorber 55. The metal part 51 has a first portion 51*a* and a second portion 51*b*. As an enlarged part A of FIG. 6 shows, a part of the metal part 51 has a two layer structure. A first layer is the first portion 51*a*. A second layer is the second portion 51*b*. As an enlarged part B of FIG. 6 shows, a portion having a one layer structure also exists in the metal part 51. A portion having only the first portion 51*a* and a portion having only the second portion 51*b* exist in the metal part 51. The second portion 51*b* is brought into contact with the cast resin 53.

Examples of a material of the vibration absorber 55 include a rubber and a resin.

A material of the metal part 51 may be a metal, and may be a compound including a metal atom.

The term "cast resin" is used in the present application. The "cast resin" in the present application is a resin cured after being cast in a liquid state. Such a forming method is also referred to as cast forming. The cast resin constitutes a part of the adherend s1 in a state where the cast resin is cast and cured. The cast resin is cast into the adherend s1 in manufacture, and is cured, to constitute a part of the adherend s1 as it is.

The bonding surface 29 is a flat surface. The bonding surface 29 is made of the cast resin 53. The bonding surface 29 is formed by cutting work. The cutting work will be described in detail later.

Figure 7:
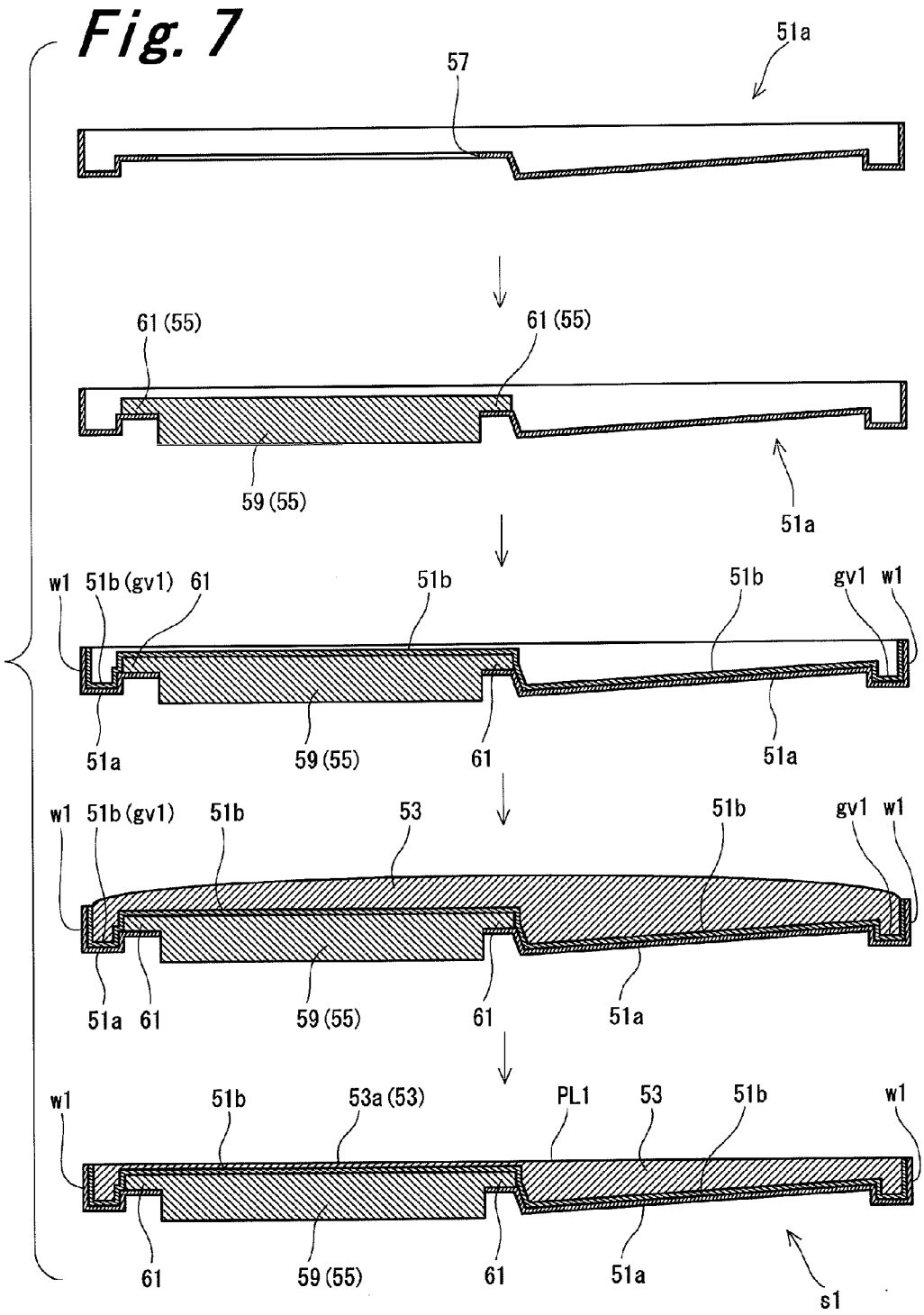
FIG. 7 shows a manufacturing process of the adherend according to the first embodiment.

FIG. 7 is a view for explaining a manufacturing method of the adherend s1. The top and bottom of the adherend s1 are inverted between FIGS. 6 and 7.

[First Step]

In the manufacturing method, first, the first portion 51*a* is prepared (see a first step of FIG. 7). The first portion 51*a* is a metal formed body. The first portion 51*a* is formed by pressing, for example. The first portion 51*a* has a through hole 57.

[Second Step]

Next, the vibration absorber 55 is disposed on the first portion 51*a* (see a second step of FIG. 7). The vibration absorber 55 has an inserting part 59 and an engaging part 61. The vibration absorber 55 is put on the first portion 51*a* in a state where the inserting part 59 is inserted into the through hole 57. In this time, the engaging part 61 is located above the first portion 51*a*.

[Third Step]

Next, the second portion 51*b* is made of a surface forming layer. The "surface forming layer" is the term defined in the present application. The "surface forming layer" means a layer directly formed on a surface of an object. Examples of the surface forming layer include plating, vapor deposition, electrocasting, and thermal spraying. Examples of the plating include electroplating and nonelectrolytic plating. Examples of the vapor deposition include physical vapor deposition (PVD) and chemical vapor deposition (CVD). The electrocasting is obtained by thickly overlapping the plating, and can be said to be a kind of the plating. Since the electrocasting has a great thickness, the electrocasting has excellent strength. Preferable examples of the surface forming layer include the electrocasting.

In the embodiment, the second portion 51*b* is formed on an upper surface of an object to be processed (see a third step of FIG. 7). Therefore, the second portion 51*b* is formed on an upper surface of the first portion 51*a* and an upper surface of the vibration absorber 55. As a result, the second portion 51*b* has a portion formed on a surface of the first portion 51*a* and a portion formed on a surface of the vibration absorber 55.

The metal part 51 made of the first portion 51*a* and the second portion 51*b* has a groove gv1 and a wall part w1 (see the third step of FIG. 7). The groove gv1 is located on a peripheral part of the metal part 51. The wall part w1 is located on the peripheral part of the metal part 51.

[Fourth Step]

Next, the cast resin 53 is formed. After the liquid cast resin 53 is cast, the cast resin 53 is cured. As a fourth step of FIG. 7 shows, the cast resin 53 covers a substantially entire upper surface of a processed body. The liquid cast resin flows into the groove gv1. Therefore, the cast resin 53 gets into the groove gv1. The cast resin 53 is brought into contact with the wall part w1.

[Fifth Step]

Next, a flat surface PL1 is formed by cutting work. In the cutting work, a thin-walled part 53*a* of the cast resin 53 is left on a surface of the second portion 51*b* (a fifth step of FIG. 7). Preferably, the cutting work is NC processing. NC stands for "Numerical Control". Processing accuracy is improved by the NC processing. Therefore, the above-mentioned thin-walled part 53*a* can be thinly formed with high dimensional accuracy. The flat surface PL1 is the above-mentioned bonding surface 29. A shape of the cutting work is the same as that of the joint surface of the head body h1. When the adherend s1 is provided on a flat surface part of the head body h1, the cutting surface is also the flat surface. When the adherend s1 is provided on a curved surface part of the head body h1, the cutting surface is also the same curved surface.

Thus, the adherend s1 shown in FIG. 6 is obtained.

As for the surface forming layer, the layer is formed along the surface of the object. Consequently, high cohesiveness of the layer is caused by the surface forming layer. On the other hand, when a member formed separately is bonded to the surface of the object, a minute gap may be produced between the member and the object. The gap reduces cohesiveness.

A thin layer can be formed by the surface forming layer. Therefore, the surface forming layer can contribute to thinning of the adherend s1. A layer 51*b* which is hardly peeled can be formed by the surface forming layer. Therefore, the surface forming layer can improve strength of the adherend s1.

In respect of durability, a thickness of a portion formed by the surface forming layer is preferably equal to or greater than 150 μm, and more preferably equal to or greater than 200 μm. In respect of suppressing a mass of the adherend, the thickness of the portion formed by the surface forming layer is preferably equal to or less than 400 μm, and more preferably equal to or less than 300 μm.

When the cast resin 53 is formed, the cast resin 53 flows along the surface of the object. Consequently, the cohesiveness of the cast resin 53 is high. The cohesiveness can improve adhesiveness. On the other hand, when a resin separately formed is bonded to the surface of the object, a minute gap may be produced between the resin and the object. The gap reduces adhesiveness. An adhesive having high affinity with a metal is different from an adhesive having high affinity with a resin. Consequently, it is difficult to strongly bond the resin to the metal. On the other hand, the cast resin 53 can improve adhesiveness caused by high cohesiveness.

As a result of the above-mentioned manufacturing method, the cast resin 53 has a formed surface F1 (not shown) formed by the above-mentioned metal part 51. The formed surface F1 is brought into contact with the metal part 51. Since the formed surface F1 is formed by casting, the formed surface F1 has high cohesiveness to the metal part 51. Generally, although the resin is hardly bonded to the metal part, the formed surface F1 has excellent adhesiveness caused by high cohesiveness.

The cast resin 53 can be thinned by cutting work. That is, even when the cast resin 53 having high adhesiveness is thinly processed, the cast resin 53 is hardly peeled. On the other hand, when a thin resin formed separately is bonded to the surface of the object, the thin resin has low cohesiveness, and is apt to be peeled.

Generally, a resin and a metal-based material are hardly bonded to each other. When the resin and the metal part are brought into contact with each other, peeling is apt to be produced on the interface between the resin and the metal part. Since the cast resin has excellent cohesiveness, the cast resin can improve adhesiveness with the metal-based material. In this respect, at least a part of the cast resin 53 is preferably brought into contact with the metal part 51. A material of the metal part is the above-mentioned metal-based material.

As shown in FIG. 6, the engaging part 61 is sandwiched between the first portion 51*a* and the second portion 51*b*. Therefore, the vibration absorber 55 is hardly come off. The metal part 51 has a portion in which the first portion 51*a* and the second portion 51*b* are brought into direct contact. Both materials of the first portion 51*a* and second portion 51*b* are metal-based materials (materials including a metal atom). The first portion 51*a* and the second portion 51*b* which are made of the approximate material have excellent adhesiveness.

The second portion 51*b* is a formed body including the surface forming layer. Since the surface forming layer is directly formed on the surface, the surface forming layer has high cohesiveness to the surface. Therefore, the interface between the first portion 51*a* and the second portion 51*b* is hardly peeled, and the interface between the second portion 51*b* and the vibration absorber 55 is hardly peeled. Also in this respect, the vibration absorber 55 is hardly come off.

The engaging part 61 is sandwiched between the first portion 51*a* and the second portion 51*b* which are hardly separated from each other. Therefore, the vibration absorber 55 is hardly come off.

The flat surface PL1 formed by cutting work can provide the bonding surface 29 planarized with a high degree of accuracy. The planarized bonding surface 29 can improve adhesive strength of the adherend s1 to the head body h1.

The thin-walled part 53*a* which is thin and hardly peeled can be formed by cutting the cast resin 53. The possible thinning of the cast resin 53 improves a degree of freedom of design of the adherend s1. For example, the thin-walled part 53*a* contributes the thinning of the adherend s1. The thin-walled part 53*a* contributes to weight reduction of the adherend s1.

As described above, although the cast resin 53 is brought into contact with the metal part 51, the cast resin 53 has high adhesiveness. Therefore, at least a part of the thin-walled part 53*a* is preferably brought into contact with the metal part 51. Although the thin-walled part 53*a* is a thin resin, the thin-walled part 53*a* is hardly peeled from the metal part 51.

In respect of advancing an effect of high adhesiveness, a thickness d1 of the thin-walled part 53*a* is preferably equal to or less than 2.5 mm, more preferably equal to or less than 1.5 mm, still more preferably equal to or less than 1.0 mm, and yet still more preferably equal to or less than 0.8 mm. In respect of durability, the thickness d1 of the thin-walled part 53*a* is preferably equal to or greater than 0.5 mm.

In the adherend s1, a surface with which the cast resin 53 is brought into contact has unevenness. That is, the surface with which the cast resin 53 is brought into contact is not a flat surface. In the adherend s1, a surface with which the cast resin 53 is brought into contact is a surface of the second portion 51*b*. Since the cast resin 53 flows on the surface of the second portion 51*b* in a liquid state, the cast resin 53 is formed along the unevenness. Therefore, the cast resin 53 has high adhesiveness to the unevenness surface. In this respect, the surface brought into contact with the cast resin 53 preferably has unevenness.

In the adherend s1, the cast resin 53 is intruded in the groove gv1. When the cast resin 53 flows on the surface of the second portion 51*b* in a liquid state, the cast resin 53 is easily intruded in the groove gv1. The intrusion of the cast resin 53 to the groove gv1 causes physical engagement. The cast resin 53 is hardly come off because of the engagement.

As the fourth step of FIG. 7 shows, the wall part w1 holds the poured liquid cast resin 53 until the cast resin 53 is cured. That is, the wall part w1 contributes to forming of the cast resin 53. The wall part w1 holds the cured cast resin 53, and thereby the cast resin 53 is hardly come off.

Figure 8:
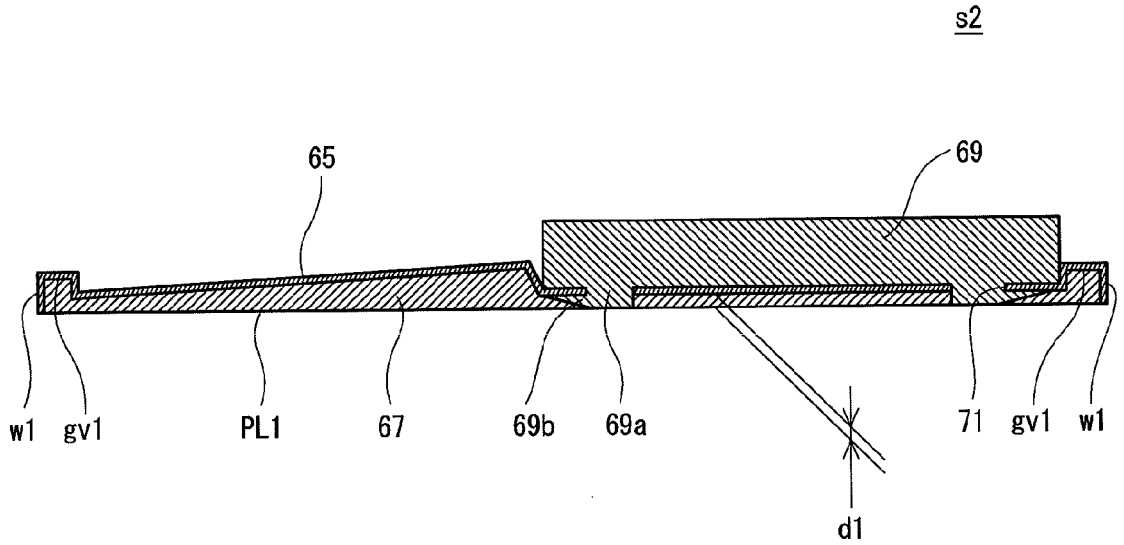
FIG. 8 is a cross sectional view of an adherend according to a second embodiment, and the second embodiment is also example 2.

FIG. 8 is a cross sectional view of an adherend s2 according to a second embodiment. The adherend s2 has a metal part 65, a cast resin 67, and a vibration absorber 69. The metal part 65 is previously formed. The metal part 65 has through holes 71. In the embodiment, two through holes 71 are formed. The metal part 65 has a groove gv1. The groove gv1 is formed along a peripheral part of the adherend s2. The metal part 65 has a wall part w1. The wall part w1 is formed along the peripheral part of the adherend s2. The cast resin 67 has a flat surface PL1 formed by cutting work. The flat surface PL1 is a bonding surface to the head body h1.

The vibration absorber 69 has an inserting part 69*a* inserted into the through hole 71 and an extended part 69*b* having a cross-sectional area greater than that of the through hole 71. The extended part 69*b* can prevent release of the vibration absorber 69.

Figure 9:
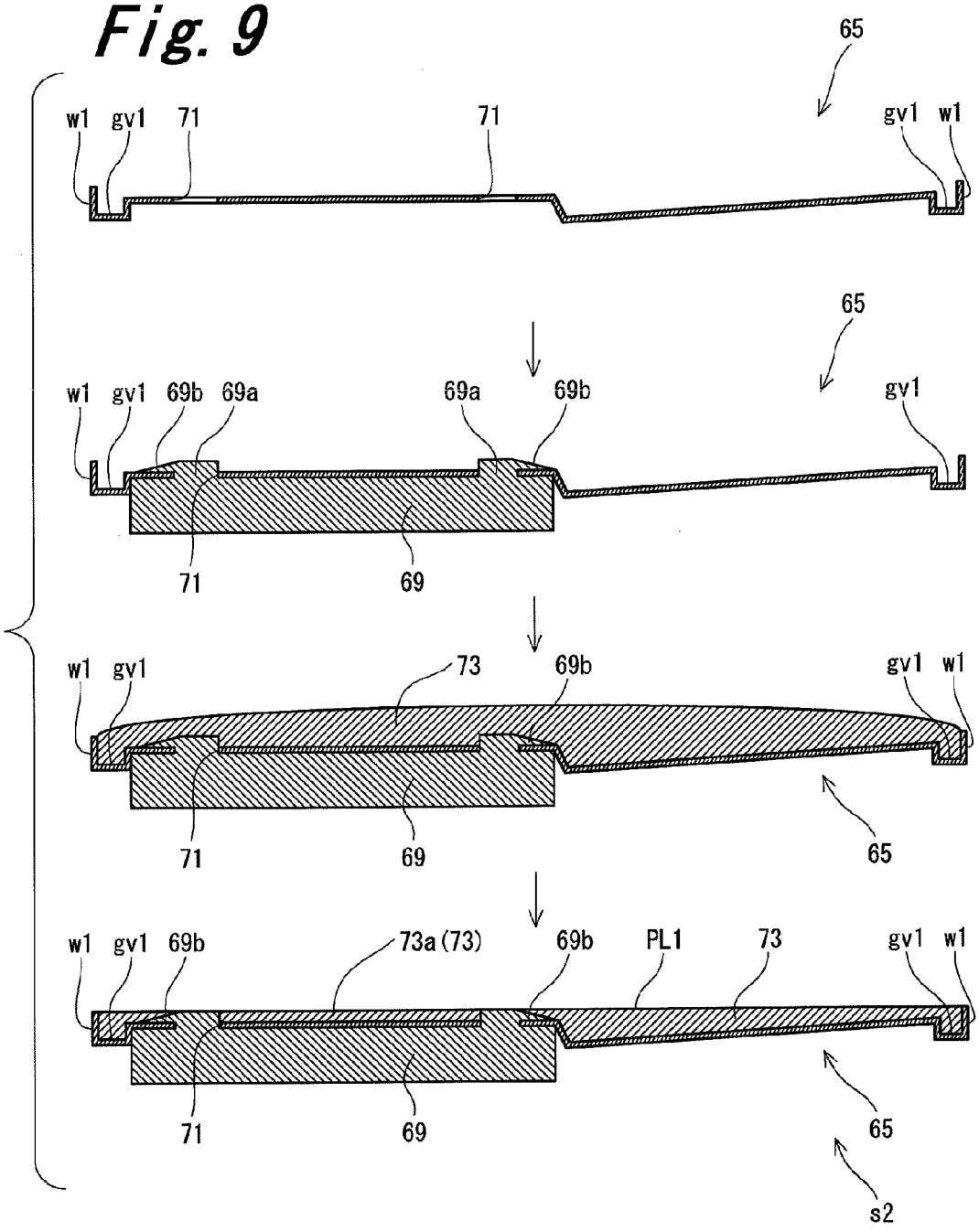
FIG. 9 shows a manufacturing process of the adherend according to the second embodiment.

FIG. 9 is a view for explaining a manufacturing method of the adherend s2. The top and bottom of the adherend s2 are inverted between FIGS. 8 and 9.

[First Step]

In the manufacturing method, first, the metal part 65 is prepared (see a first step of FIG. 9). The metal part 65 is a metal formed body. The metal part 65 is formed by pressing, for example. The metal part 65 has the through holes 71.

[Second Step]

Next, the vibration absorber 69 is disposed on the metal part 65 (see a second step of FIG. 9). The extended part 69*b* is inserted into the through hole 71 using elastic deformation. As the second step of FIG. 9 shows, the vibration absorber 69 is attached to the metal part 65 by the insertion. At this time, the extended part 69*b* is located above the metal part 65.

[Third Step]

Next, a cast resin 73 is formed. After the liquid cast resin 73 is cast, the cast resin 73 is cured. As a third step of FIG. 9 shows, the cast resin 73 covers a substantially entire upper surface of a processed body. The liquid cast resin flows into the groove gv1. Therefore, the cast resin 73 gets into the groove gv1. The cast resin 73 is brought into contact with the wall part w1.

[Fourth Step]

Next, the flat surface PL1 is formed by cutting work. In the cutting work, a thin-walled part 73*a* of the cast resin 73 is left on a surface of the metal part 65 (a fourth step of FIG. 9). Preferably, the cutting work is NC processing.

Thus, the adherend s2 shown in FIG. 8 is obtained.

As a result of the above-mentioned manufacturing method, the cast resin 73 has a formed surface F1 (not shown) formed by the above-mentioned metal part 65. The formed surface F1 is brought into contact with the metal part 65. Since the formed surface F1 is formed by casting, the formed surface F1 has high cohesiveness to the metal part 65. Generally, although the resin and the metal part are hardly bonded to each other, the formed surface F1 has excellent adhesiveness caused by high cohesiveness.

The cast resin 73 has a formed surface F2 (not shown) formed by the above-mentioned vibration absorber 69. The formed surface F2 is brought into contact with the vibration absorber 69. Since the formed surface F2 is formed by casting, the formed surface F2 has high cohesiveness to the vibration absorber 69. The formed surface F2 has excellent adhesiveness caused by high cohesiveness.

The vibration absorber 69 has a portion sandwiched between the metal part 65 and the cast resin 73. In the embodiment, the extended part 69*b* is sandwiched between the metal part 65 and the cast resin 73. Consequently, the vibration absorber 69 is hardly come off.

Figure 10:
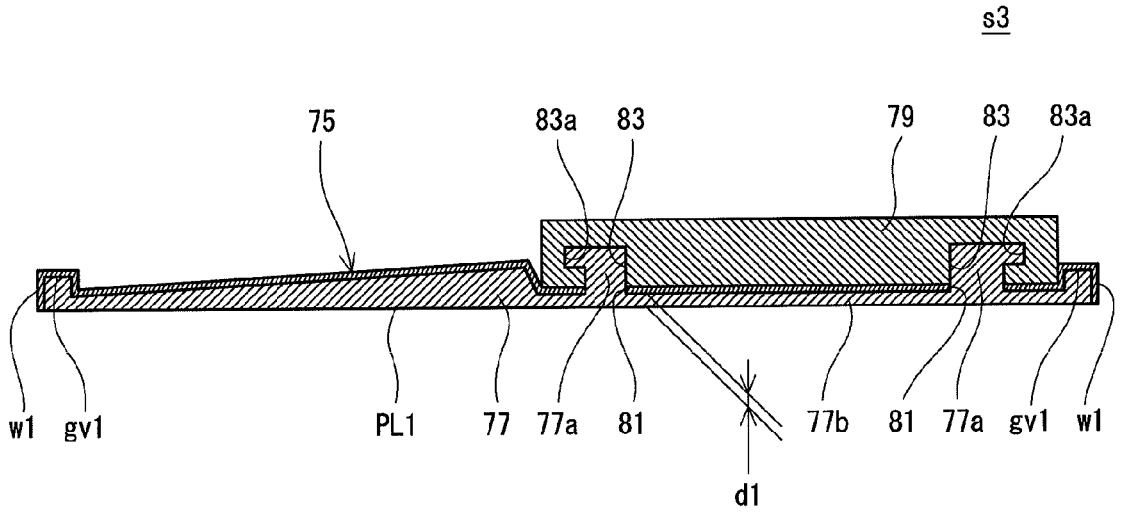
FIG. 10 is a cross sectional view of an adherend according to a third embodiment, and the third embodiment is also example 3.

FIG. 10 is a cross sectional view of an adherend s3 according to a third embodiment. The adherend s3 has a metal part 75, a cast resin 77, and a vibration absorber 79. The metal part 75 is previously formed. The metal part 75 has through holes 81. In the embodiment, two through holes 81 are formed. The metal part 75 has a groove gv1. The groove gv1 is formed along a peripheral part of the adherend s3. The metal part 75 has a wall part w1. The wall part w1 is formed along the peripheral part of the adherend s3. The cast resin 77 has a flat surface PL1 formed by cutting work. The flat surface PL1 is a bonding surface with the head body h1.

The vibration absorber 79 has a recess part 83. The recess part 83 has an enlarged part 83*a*. A cross-sectional area of the enlarged part 83*a* is greater than an opening area of the recess part 83. The cast resin 77 has an extended part 77*a* getting into the recess part 83. The extended part 77*a* fill up the recess part 83. The vibration absorber 79 is hardly come off by the extended part 77*a*.

Figure 11:
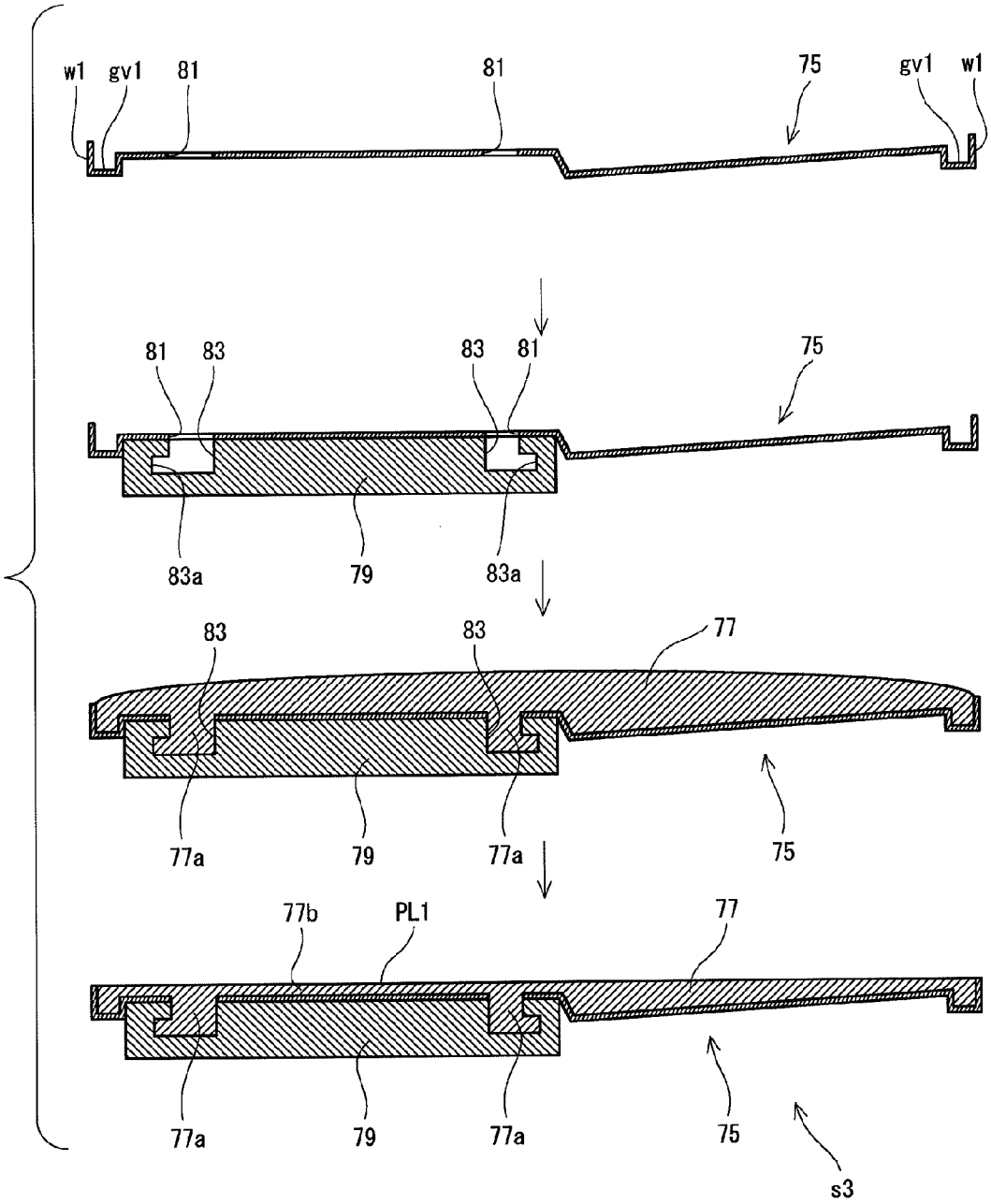
FIG. 11 shows a manufacturing process of the adherend according to the third embodiment.

FIG. 11 is a view for explaining a manufacturing method of the adherend s3. The top and bottom of the adherend s3 are inverted between FIGS. 10 and 11.

[First Step]

In the manufacturing method, first, the metal part 75 is prepared (see a first step of FIG. 11). The metal part 75 is a metal formed body. The metal part 75 is formed by pressing, for example. The metal part 75 has a through hole 81.

[Second Step]

Next, the vibration absorber 79 is disposed on the metal part 75 (see a second step of FIG. 11). The vibration absorber 79 is disposed on the metal part 75 in a position where an opening of the recess part 83 is in communication with the through hole 81.

[Third Step]

Next, a cast resin 77 is formed. After the liquid cast resin 77 is cast, the cast resin 77 is cured. As a third step of FIG. 11 shows, the cast resin 77 covers a substantially entire upper surface of a processed body. The liquid cast resin 77 flows into the recess part 83. The liquid cast resin 77 flows into the enlarged part 83*a*. Therefore, the extended part 77*a* is formed. The extended part 77*a* can function as a coming-off stopper of undercut.

[Fourth Step]

Next, the flat surface PL1 is formed by cutting work. In the cutting work, a thin-walled part 77*b* of the cast resin 77 is left on a surface of the metal part 75 (a fourth step of FIG. 11). Preferably, the cutting work is NC processing.

Thus, the adherend s3 shown in FIG. 10 is obtained.

The cast resin 77 gets into the recess part 83 of the vibration absorber 79. The vibration absorber 79 is hardly come off because of engagement between the extended part 77*a* of cast resin 77 and the recess part 83.

Figure 12:
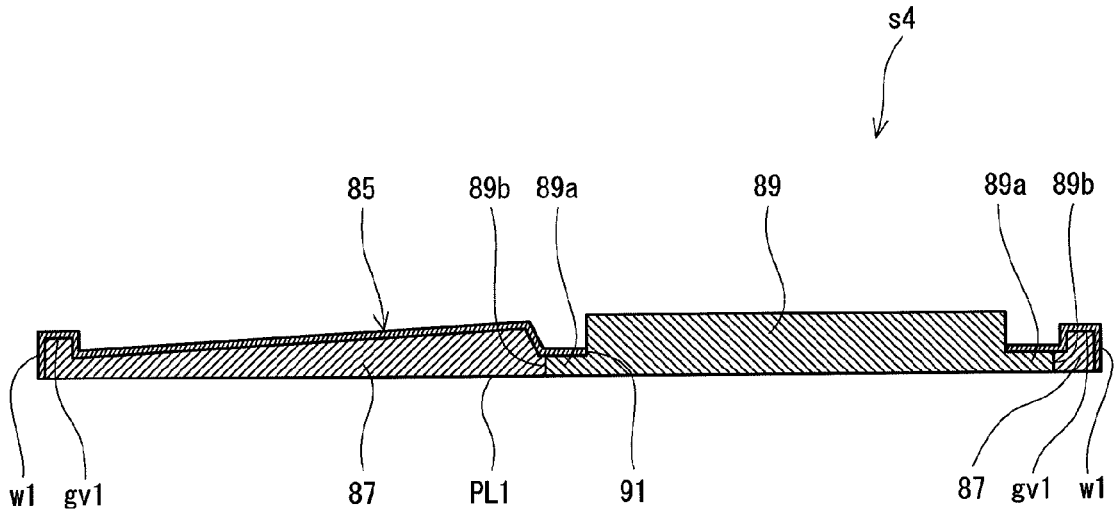
FIG. 12 is a cross sectional view of an adherend according to a fourth embodiment, and the fourth embodiment is also example 4.

FIG. 12 is a cross sectional view of an adherend s4 according to a fourth embodiment. The adherend s4 has a metal part 85, a cast resin 87, and a vibration absorber 89. The metal part 85 is previously formed. The metal part 85 has a through hole 91. The metal part 85 has a groove gv1. The groove gv1 is formed along a peripheral part of the adherend s4. The metal part 85 has a wall part w1. The wall part w1 is formed along the peripheral part of the adherend s4. The cast resin 87 has a flat surface PL1 formed by cutting work. The flat surface PL1 is a bonding surface with the head body h1.

The vibration absorber 89 has an engaging part 89*a*. The vibration absorber 89 is hardly come off because of the engaging part 89*a*.

In the embodiment, the thin-walled part of the cast resin 87 does not exist on the surface of the vibration absorber 89. In the embodiment, the vibration absorber 89 constitutes a part of flat surface PL1. In the cutting work, the cast resin 87 and the vibration absorber 89 are cut. The present invention enables also such an aspect. A side surface 89*b* of the vibration absorber 89 is brought into contact with the cast resin 87. Therefore, in the side surface 89*b*, adhesive strength of the cast resin 87 and vibration absorber 89 is high.

Examples of a rubber used for the vibration absorber include a butadiene rubber (BR), a styrene-butadiene rubber (SBR), an acrylonitrile-butadiene rubber (NBR), a chloroprene rubber (CR), an ethylene propylene diene rubber (EPDM), a silicone rubber, an isoprene rubber, and a natural rubber. Rubber compositions containing these rubbers as a base material rubber may be used as the vibration absorber.

Examples of a main component of a resin composition capable of being used for the vibration absorber include an ionomer resin, a styrene block-containing thermoplastic elastomer, a thermoplastic polyester elastomer, a thermoplastic polyamide elastomer, and a thermoplastic polyolefin elastomer.

The ionomer resin is preferably a copolymer of ethylene and acrylic acid or ethylene and methacrylic acid. Specific examples of the ionomer resin include "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329" (trade names) commercially available from Du Pont-Mitsui Polychemicals Co., Ltd.; "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000" (trade names) commercially available from E.I. du Pont de Nemours and Company; and "IOTEK7010", "IOTEK7030", "IOTEK7510", "IOTEK7520", "IOTEK8000", and "IOTEK8030" (trade names) commercially available from Exxon Mobil Corporation.

The other examples of the main component include a thermoplastic resin such as a thermoplastic polyamide elastomer, a thermoplastic polystyrene elastomer, a thermoplastic polyester elastomer, or a thermoplastic polyurethane elastomer. The other examples of the main component resin include a resin obtained by cross-linking a rubber composition using sulfur, an organic peroxide or the like, and a thermosetting resin such as a thermosetting polyurethane resin, an epoxy resin, or a phenol resin. The main component resin may be a mixture of the above-mentioned thermoplastic resin and the above-mentioned thermosetting resin.

For example, a thermoplastic polyamide elastomer ("Pebax" (trade name, for example, "Pebax 2533") commercially available from Arkema Inc.); a thermoplastic polyester elastomer ("Hytrel" (trade name, for example, "Hytrel 3548" and "Hytrel 4047") commercially available from Du Pont-Toray Co., Ltd.); a thermoplastic polystyrene elastomer ("Rabalon" (trade name) commercially available from Mitsubishi Chemical Corporation) or thermoplastic polyester elastomer ("Primalloy" (trade name) commercially available from Mitsubishi Chemical Corporation); and a thermoplastic polyurethane elastomer ("Elastollan" (trade name), for example, "Elastollan ET880") commercially available from BASF Japan Ltd. can be used as the main component.

A urethane resin containing an elastomer having a hard segment and a soft segment may be used as the main component.

In respect of easiness of forming, the material of the vibration absorber is preferably a thermoplastic resin composition. Examples of a base material polymer of the resin composition include a thermoplastic polyurethane elastomer, a thermoplastic polyester elastomer, a thermoplastic polyamide elastomer, a thermoplastic polyolefin elastomer, a thermoplastic polystyrene elastomer, and an ionomer resin. One example of the base material polymer is preferably the thermoplastic polyurethane elastomer. The thermoplastic polyurethane elastomer is flexible, and has excellent vibration absorptivity. The thermoplastic polyurethane elastomer contains a polyurethane component as a hard segment, and a polyester component or a polyether component as a soft segment. Examples of a curing agent of the polyurethane component include alicyclic diisocyanate, aromatic diisocyanate, and aliphatic diisocyanate. In particular, the alicyclic diisocyanate is preferable. Since the alicyclic diisocyanate has a main chain having no double bond, yellowing is suppressed. In addition, since the alicyclic diisocyanate has excellent strength, the alicyclic diisocyanate has high durability. Two types of diisocyanates or more may be used in combination.

Specific examples of the thermoplastic polyurethane elastomer include "Elastollan XNY90A" (trade name), "Elastollan XNY97A" (trade name), "Elastollan XNY585" (trade name), and "Elastollan XKP016N" (trade name) available from BASF Japan Ltd.; and "Resamine P4585LS" (trade name) and "Resamine PS62490" (trade name) available from Dainichiseika Color & Chemicals Mfg. Co., Ltd.

In respect of durability, a loss tangent tan δ of the vibration absorber is preferably equal to or greater than 0.07, and more preferably equal to or greater than 0.10. In respect of vibration absorptivity, the loss tangent tan δ of the vibration absorber is preferably equal to or less than 0.25, and more preferably equal to or less than 0.23. For example, a loss tangent tan δ of the butadiene rubber (BR) is about 0.20 or greater and about 0.25 or less. For example, a loss tangent tan δ of the styrene-butadiene rubber (SBR) is about 0.07 or greater and about 0.20 or less.

The above-mentioned loss tangent tan δ is measured with a viscoelastic spectrometer ("VESF-3" available from Iwamoto Seisakusho Co., LTD.) in conformity to a rule defined by "JIS-K 6394" under the following conditions.

Initial strain: 10%
Amplitude: 2% (one-side amplitude)
Frequency: 10 Hz
Deformation mode: Tension
Starting temperature: −100° C.
Ending temperature: 100° C.
Temperature rising rate: 3° C./min
Temperature at measurement: 70° C.

A specimen provided for the measurement with the viscoelastic spectrometer has a plate shape. The specimen has a length of 45 mm, a width of 4 mm, and a thickness of 2 mm. The specimen is gripped at both ends thereof to carry out the measurement. The specimen has a displacement part with a length of 30 mm. From the same composition as the vibration absorber, a slab having a thickness of 2 mm is formed through a metal mold. The specimen is punched out from the slab.

In respect of durability, type A durometer hardness (JIS-K6253-1997) of the vibration absorber is preferably equal to or greater than 20, and more preferably equal to or greater than 25. In respect of vibration absorptivity, the type A durometer hardness (JIS-K 6253-1997) of the vibration absorber is preferably equal to or less than 70, more preferably equal to or less than 60, and still more preferably equal to or less than 50.

In respect of vibration absorptivity, a nonwoven fabric layer preferably exists in the double-stick tape t1. Examples of the nonwoven fabric include a wet type nonwoven fabric and a dry type nonwoven fabric.

The manufacturing method of the nonwoven fabric constituting the above-mentioned nonwoven fabric layer is not restricted. Examples of the manufacturing method of the nonwoven fabric include a thermal bond method, a chemical bond method, a needle punch method, a spunlace method (water flow interlacing method), a stitch bond method, and a steam jet method. When a polyester fiber or a nylon fiber is used as the fiber, the nonwoven fabric manufactured by the thermal bond method is preferable in respect of productivity and strength.

The material of the nonwoven fabric constituting the nonwoven fabric layer is not restricted. Examples of the material of the nonwoven fabric include a natural fiber, a synthetic fiber, and a regenerated fiber. Examples of the synthetic fiber include vinylon, polyester, polypropylene, polyethylene, and nylon. Examples of the natural fiber include hemp. Examples of the regenerated fiber include rayon. In view of weatherability and strength, the synthetic fiber is preferable, and polyester and nylon are more preferable.

The pressure-sensitive adhesive used for the pressure-sensitive adhesive layer of the double-stick tape t1 is not restricted. Examples of the pressure-sensitive adhesive include an acrylic pressure-sensitive adhesive, an epoxy pressure-sensitive adhesive, and a urethane pressure-sensitive adhesive.

A thickness of the double-stick tape t1 is not restricted. In respect of vibration absorptivity, the thickness of the double-stick tape t1 is preferably equal to or greater than 0.1 mm, and more preferably equal to or greater than 0.2 mm. In respect of durability, the thickness of the double-stick tape t1 is preferably equal to or less than 0.4 mm, and more preferably equal to or less than 0.3 mm.

The specific examples of the double-stick tape t1 include "Y-4625" (trade name), "VHX-802" (trade name), "Y-9448HK" (trade name), "4393" (trade name), "Y-9448HK" (trade name), "Y-9448HKB" (trade name), and "Y-9448SK" (trade name). All of them are manufactured by Sumitomo 3M Limited.

The material of the head body h1 is not restricted. Examples of the material of the head body h1 include soft iron (low carbon steel having a carbon content of less than 0.3 wt %), carbon fiber reinforced plastic (CFRP), maraging steel, stainless steel, a titanium alloy, an aluminium alloy, and a magnesium alloy. The whole of the head body h1 may be integrally formed, or the head body h1 may be produced by joining a plurality of members. For example, the head body may be produced by combining a flat plate-shaped face member with a face opening member. In this case, as the face member, a titanium alloy is suitable. As the face opening member, stainless steel is suitable. Examples of a method for formed the head body or a component thereof include forging and casting.

The adherend is preferably disposed on a back surface of the face surface 5. The double-stick tape t1 is preferably disposed between the back surface of the face surface 5 and the adherend. A ball directly collides with the face surface 5. A great impact force is applied to the face surface 5 by hitting of the ball. The adherend located on the back surface (back side) of the face surface 5 can efficiently exhibit a vibration absorbing effect.

The material of the cast resin is material capable of being cured after the cast resin is cast in a liquid state. The curing method is not restricted. Examples thereof include curing due to a curing agent, curing due to irradiation of light ray such as ultraviolet rays, and curing due to heating. Preferably, the cast resin is obtained by casting a liquid monomer and then curing the monomer by polymerizing.

Examples of a base material resin of the cast resin include an epoxy resin, an unsaturated polyester resin, a urea resin, a silicone resin, an acrylic resin, a methacrylic resin, a polyurethane resin, a polyamide resin, and a polyimide resin. In respect of strength and formability, the epoxy resin is preferable. A raw material monomer of the epoxy resin contains two or more epoxy groups in a molecule.

A material of the metal part contains a metal atom. The metal part may be independently formed as in the above-mentioned first portion 51*a*. The metal part may be formed by the surface forming layer as in the above-mentioned second portion 51*b*. As in the above-mentioned metal part 51, the metal part may have the first portion 51*a* independently formed and the second portion 51*b* formed by the surface forming layer.

Examples of a material of the metal part independently formed include stainless steel, titanium, a titanium alloy, aluminum, an aluminium alloy, a magnesium alloy, nickel, and a nickel alloy.

Examples of a material of the metal part formed by the surface forming layer include a material capable of being formed by plating or electrocasting, and a material capable of being formed by vapor deposition. In respect of advancing an effect of high adhesiveness, the material of the metal part formed by the surface forming layer is preferably a material containing the same metal atom as the metal part (the above-mentioned first portion) capable of being independently formed, and more preferably the same metal as the metal part (the above-mentioned first portion) capable of being independently formed. In this respect, the material of the metal part formed by the surface forming layer is particularly preferably nickel.

EXAMPLES

Hereinafter, the effects of the present invention will be clarified by examples. However, the present invention should not be interpreted in a limited way based on the description of the examples.

Example 1

The above-mentioned head 1 having the above-mentioned adherend s1 was used as example 1. The head 1 was a five-iron. A manufacturing method of the adherend s1 is as described above. SUS630 stainless steel was used for a portion except a face plate in a head body. The portion of the head body was manufactured by lost-wax precision casting. 51AF Ti (Ti-5Al-1Fe) was used for a material of the face plate. The face plate was obtained by punching a plate material and further subjecting the plate material to NC processing. In the adherend s1, BR was used for a material of a vibration absorber, and stainless steel was used for a material of a first portion of a metal part. A second portion of the metal part was formed by electrocasting. Nickel was used for a material of the second portion. An epoxy resin was used as a cast resin. A thickness d1 (see FIG. 6) of a thin-walled part was set to 0.5 mm.

"Y-4625" (trade name) manufactured by Sumitomo 3M Limited was used as a double-stick tape. After the double-stick tape having the same shape as that of a batch (adherend s1) was stuck on the batch, the batch was stuck on the head body. Then, the batch was pressed to the head body to obtain a head with the batch. A thickness of the double-stick tape "Y-4625" was 0.25 mm. The head was mounted to a tip part of a shaft made of CFRP. "MP-600" (trade name) manufactured by SRI Sports Limited was used as the shaft. A grip was mounted to a butt end part of the shaft to obtain a golf club according to example 1. The double-stick tape "Y-4625" has a five layer structure described in FIG. 4. These five layers are an acrylic pressure-sensitive adhesive layer, a acrylic resin layer having no bubble, a nonwoven fabric layer, an acrylic resin layer having no bubble, and an acrylic pressure-sensitive adhesive layer in this order from the inner side. Specification and evaluation results of example 1 are shown in the following Table 1.

Example 2

The above-mentioned adherend s2 shown in FIG. 8 was used. A manufacturing method of the adherend s2 is as described above. In the adherend s2, BR was used for a material of a vibration absorber, and stainless steel was used for a material of a metal part. An epoxy resin was used as a cast resin. A thickness d1 (see FIG. 8) of a thin-walled part was set to 2.0 mm. A golf club according to example 2 was obtained in the same manner as in example 1 except that the adherend s1 was changed to the adherend s2. Specification and evaluation results of example 2 are shown in the following Table 1.

Example 3

The above-mentioned adherend s3 shown in FIG. 10 was used. A manufacturing method of the adherend s3 is as described above. In the adherend s3, BR was used for a material of a vibration absorber, and stainless steel was used for a material of a metal part. An epoxy resin was used as a cast resin. A thickness d1 (see FIG. 10) of a thin-walled part was set to 0.5 mm. A golf club according to example 3 was obtained in the same manner as in example 1 except that the adherend s1 was changed to the adherend s3. Specification and evaluation results of example 3 are shown in the following Table 1.

Example 4

The above-mentioned adherend s4 shown in FIG. 12 was used. A manufacturing method of the adherend s4 is as described above. In the adherend s4, NBR was used for a material of a vibration absorber, and an aluminium alloy was used for a material of a metal part. An epoxy resin was used as a cast resin. A golf club according to example 4 was obtained in the same manner as in example 1 except that the adherend s1 was changed to the adherend s4. Specification and evaluation results of example 4 are shown in the following Table 1.

Comparative Example 1

Figure 13:
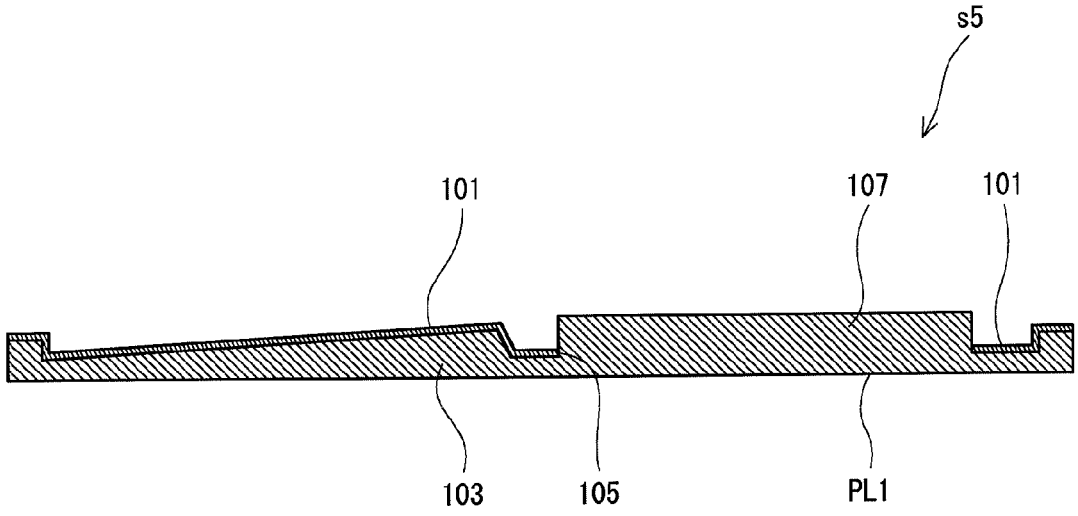
FIG. 13 is a cross sectional view of an adherend according to comparative example 1.

FIG. 13 is a cross sectional view of an adherend s5 used for comparative example 1. The adherend s5 has a resin formed body 101 and a vibration absorber 103. The resin formed body 101 has a through hole 105. The resin formed body 101 has an insertion part 107 inserted into the through hole 105. An ABS resin was used for a material of the resin formed body 101. BR was used for a material of the vibration absorber 103. An epoxy adhesive was used for bonding the members.

The vibration absorber 103 has a cut flat surface PL1. A method of the cutting work was the same as that of example 1.

The resin formed body 101 was previously formed. The vibration absorber 103 was also previously formed. The resin formed body 101 and the vibration absorber 103 were bonded to each other using an adhesive.

A golf club according to comparative example 1 was obtained in the same manner as in example 1 except that the adherend s5 was used in place of the adherend s1. Specification and evaluation results of comparative example 1 are shown in the following Table 1.

Comparative Example 2

Figure 14:
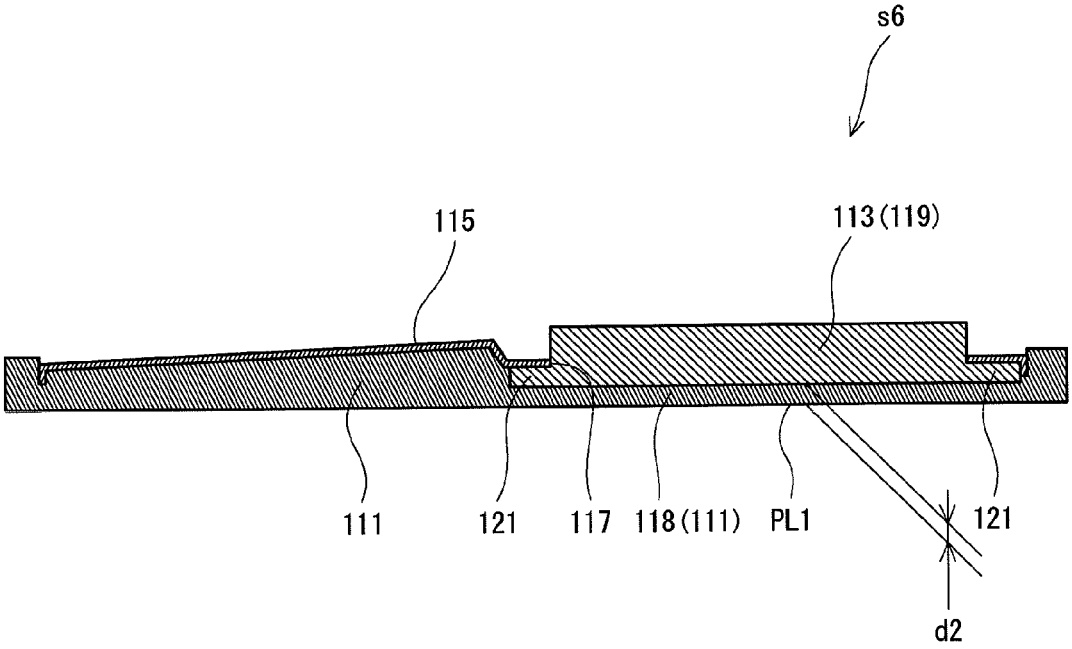
FIG. 14 is a cross sectional view of an adherend according to comparative example 2.

FIG. 14 is a cross sectional view of an adherend s6 used for comparative example 2. The adherend s6 has a resin formed body 111, a vibration absorber 113, and a metal part 115. The resin formed body 111 has a through hole 117. The resin formed body 111 has a thin-walled part 118 disposed on a back side of the vibration absorber 113. Furthermore, the resin formed body 111 has an insertion section 119 inserted into the through hole 117. Furthermore, the resin formed body 111 has an engaging part 121 sandwiched between the vibration absorber 113 and the metal part 115. An ABS resin was used for a material of the resin formed body 111. NBR was used for a material of the vibration absorber 113. Stainless steel was used for a material of the metal part 115. An epoxy adhesive was used for bonding the members.

The resin formed body 111 has a cut flat surface PL1. A method of the cutting work was the same as that of example 1. A thickness d2 (see FIG. 14) of a thin-walled part disposed inside the vibration absorber 113 was set to 0.5 mm.

The resin formed body 111 was previously formed. The vibration absorber 113 was also previously formed. The metal part 115 was previously formed by pressing. Members were bonded using an adhesive.

A golf club according to comparative example 2 was obtained in the same manner as in example 1 except that the adherend s6 was used in place of the adherend s1. Specification and evaluation results of comparative example 2 are shown in the following Table 1.

[Evaluation Methods]

[Evaluation of Durability]

Each of the clubs was mounted to a swing robot (manufactured by Miyamae Co., Ltd.) and the swing robot hit golf balls at a head speed of 54 m/s. A state of each of heads was visually observed every 500 hits, and the state of the badge was confirmed. The hit was completed when peeling was confirmed. Evaluation was completed after 5000 hits. Evaluation results thereof are shown in the following Table 1.

[Evaluation of Productivity]

In each of ten heads, the batch on which the double-stick tape was stuck was stuck on the head body. Productivity was evaluated based on easiness and working hours of sticking work. The evaluation was relative evaluation to comparative example 2. Evaluation results thereof are shown in the following Table 1.

[Sensory Evaluation of Hitting Feeling]

A badge made of stainless steel was prepared. The badge was produced by pressing. An evaluation standard club was obtained in the same manner as in example 1 except that the badge was used in place of the adherend s1. Each of eight testers hit eight golf balls using each of the clubs. A hitting feeling of each of the clubs was evaluated by relatively comparing each of the clubs with the above-mentioned evaluation standard club. Evaluation was made at the following four stages. The highest evaluation is A; the second highest evaluation is B; the third highest evaluation is C; and the lowest evaluation is D.

A: a hitting feeling of the clubs is very good as compared with that of the above-mentioned evaluation standard club;

B: a hitting feeling of the clubs is good as compared with that of the above-mentioned evaluation standard club;

C: a hitting feeling of the clubs is slightly good as compared with that of the above-mentioned evaluation standard club; and D: a hitting feeling of the clubs is equivalent to that of the above-mentioned evaluation standard club.

Evaluations of eight testers were totaled. The most common evaluations are shown in the following Table 1.

[Sensory Evaluation of Appearance]

Ten badges for the above-mentioned evaluation standard club were produced. These badges were used as evaluation standard. Ten badges for each of examples and comparative examples were also produced. Appearances of these badges were evaluated by the above-mentioned eight testers. The evaluation is relative evaluation to the above-mentioned evaluation standard badges. Evaluation items are two. The first item thereof is variation in appearance, and the second item is high-class feeling of appearance.

The variation in appearance of each of badges was evaluated by the following standards:

A: the variation in appearance of the badges is comparable as that of the standard badge; and B: the variation in appearance of the badges is greater than that of the standard badge.

Evaluations of the eight testers were totaled. The most common evaluations are shown in the following Table 1.

The high-class feeling of appearance of each of badges was estimated by the following standards:

A: the high-class feeling of appearance of the badges is comparable as that of the standard badge;

B: the high-class feeling of appearance of the badges is slightly inferior to that of the standard badge; and C: the high-class feeling of appearance of the badges is inferior to that of the standard badge.

Evaluations of the eight testers were totaled. The most common evaluations are shown in the following Table 1.

TABLE 1

Specification and evaluation results of examples and comparative examples

| | Example 1 | Example 2 | Example 3 | Example 4 | Comparative example 1 | Comparative example 2 |
|---|---|---|---|---|---|---|
| Structure | FIG. 6 | FIG. 8 | FIG. 10 | FIG. 12 | FIG. 13 | FIG. 14 |
| Durability | No defect after 5000 hits | No defect after 5000 hits | No defect after 5000 hits | No defect after 5000 hits | Peeling after 4000 hits | Peeling after 3500 hits |
| Productivity | Higher than comparative example 2 | Higher than comparative example 2 | Equivalent to comparative example 2 | Equivalent to comparative example 2 | Higher than comparative example 2 | — |
| Sensory evaluation of hitting feeling | B | C | C | A | A | B |
| Sensory evaluation of appearance (variation) | A | A | A | A | B | B |
| Sensory evaluation of appearance (high-class feeling) | A | B | B | A | C | B |

In comparative example 1, peeling was observed in the bonding surface between the head body and the batch at the point of 4000 hits. In comparative example 2, peeling was observed between the thin-walled part 118 of the resin formed body 111 and the vibration absorber 113 at the time of 3500 hits.

As shown above, examples are highly evaluated as compared with comparative examples. From the evaluation results, the advantages of the present invention are apparent.

The present invention can be applied to all golf club heads such as a wood type head, a utility type head, a hybrid type head, an iron type golf head, and a putter head or the like.

The description hereinabove is merely for an illustrative example, and various modifications can be made in the scope not to depart from the principles of the present invention.

What is claimed is:

1. A golf club head comprising: a head body; and an adherend, wherein the adherend has a cast resin formed by casting, a metal part, and a vibration absorber, wherein the cast resin constitutes a part of the adherend in a state in which the cast resin is cast in a liquid state and cured, the cast resin has a formed surface formed by the metal part, and the cast resin further has a formed surface formed by the vibration absorber.

2. The golf club head according to claim 1, wherein the vibration absorber is exposed.

3. The golf club head according to claim 1, wherein the vibration absorber has a portion sandwiched between the cast resin and the metal part.

4. The golf club head according to claim 1, wherein the metal part has a first portion and a second portion;

the second portion is made of a surface forming layer;

a portion in which the first portion and the second portion are brought into contact exists; and a portion in which the cast resin and the second portion are brought into contact exists.

5. The golf club head according to claim 1, wherein the metal part has a first portion and a second portion;

the second portion is made of a surface forming layer;

a portion in which the first portion and the second portion are brought into contact exists; and the vibration absorber has a portion sandwiched between the first portion and the second portion.

6. The golf club head according to claim 1, wherein the cast resin has a cutting surface, and the cutting surface is a joint surface of the adherend to the head body.

7. The golf club head according to claim 6, wherein the cast resin has a thin-walled part having a thickness equal to or less than 2.5 mm between the cutting surface and the metal part.

8. The golf club head according to claim 1, wherein a loss tangent tan δ of the vibration absorber is 0.07 or greater and 0.25 or less.

9. A golf club head comprising: a head body; and an adherend, wherein the adherend has a cast resin formed by casting, a metal part, and a vibration absorber, wherein a base material of the cast resin is an epoxy resin, the cast resin constitutes a part of the adherend in a state in which the cast resin is cast in a liquid state and cured, and the cast resin has a formed surface formed by the metal part.

10. A golf club head comprising: a head body; and an adherend, wherein the adherend has a cast resin formed by casting, a metal part, and a vibration absorber, wherein the cast resin constitutes a part of the adherend in a state in which the cast resin is cast in a liquid state and cured, the cast resin has a formed surface formed by the metal part, the cast resin has a cutting surface, and the cutting surface is a joint surface of the adherend to the head body.

* * * * *